United States Patent [19]

Silvestri, Jr.

[11] 4,156,349

[45] May 29, 1979

[54] DRY COOLING POWER PLANT SYSTEM

[75] Inventor: George J. Silvestri, Jr., Upper Chichester, Pa.

[73] Assignee: Westinghouse Electric Corp., Pittsburgh, Pa.

[21] Appl. No.: 834,363

[22] Filed: Sep. 19, 1977

[51] Int. Cl.[2] ..... F01K 9/02

[52] U.S. Cl. ..... 60/692; 60/693; 165/DIG. 1; 165/110

[58] Field of Search ..... 60/685, 690, 693, 692, 60/691; 165/DIG. 1, 107, 110

[56] References Cited

U.S. PATENT DOCUMENTS

| | | | |
|---|---|---|---|
| 3,423,078 | 1/1969 | May | 165/DIG. 1 |
| 3,820,334 | 6/1974 | Heller et al. | 60/693 X |
| 3,820,336 | 6/1974 | Schwarzenbach | 60/693 |
| 3,831,667 | 8/1974 | Kilgore et al. | 165/DIG. 1 |
| 3,881,548 | 5/1975 | Budenholzer | 60/693 X |
| 3,977,196 | 8/1976 | Sedille | 60/693 X |

FOREIGN PATENT DOCUMENTS

| | | | |
|---|---|---|---|
| 514551 | 10/1952 | Belgium | 60/693 |
| 2251407 | 10/1972 | Fed. Rep. of Germany | 60/693 |
| 2518161 | 10/1976 | Fed. Rep. of Germany | 60/693 |

OTHER PUBLICATIONS

Peake et al., CC Multipressure Condenser Application, ASME, Winter Meeting, Chicago, Ill., 11/8/65.

*Primary Examiner*—Albert W. Davis, Jr.
*Attorney, Agent, or Firm*—J. W. Keen

[57] ABSTRACT

A power plant system utilizing a zoned or multipressure condenser or cooling tower whose different zones are air-cooled in a dry manner. The zoned condenser may condense motive cycle fluid by passing it directly through air-cooled heat exchange conduits or by passing a dense fluid through an intermediate, zoned condenser where it boils as it absorbs heat from the cycle fluid and then through the aforementioned zoned, cooling tower. A separate coolant circuit is used between each intermediate condenser zone and the cooling tower. Each intermediate condenser zone is maintained at a predetermined pressure by the coolant flowing through one of the coolant circuits and transporting heat therewith from the intermediate condenser to air flowing through the dry cooling tower. To obtain different boiling and condensing temperatures in the coolant circuits different coolants or different coolant pressures must be utilized therein. The coolant circuits are preferably arranged in the dry cooling tower in series airflow relation in the order or increasing coolant circuit temperature along the direction of normal cooling air flow. Zoned, multi-pressure condensers increase efficiency of the power plant system while the use of such dense, boiling coolant can decrease the surface area required in the intermediate condenser and cooling tower and reduce the amount of coolant that must be circulated therebetween.

2 Claims, 4 Drawing Figures

DRY COOLING POWER PLANT SYSTEM

BACKGROUND OF THE INVENTION

1. Field of the Invention

This invention relates to power plant systems having elastic fluid turbines, and more particularly, to means for increasing the power plant's cycle efficiency using a dry cooling scheme.

2. Description of the Prior Art

Cycle efficiency of power plant systems increases when zoned or multi-pressure condensers are used. Such use is most feasible on elastic fluid turbines having multiple exhaust ports. When it is desired to pass elastic cycle fluid on the shell side of a condenser, zoning may consist of physically separating the condenser shells or dividing one shell by including appropriate divisional walls. When it is desired to pass elastic cycle fluid through heat exchange conduits, physical division of the shell is unnecessary since zoning results from segregating the cycle fluid exiting from each turbine exhaust port in a separate conduit or set of conduits.

Cooling the condensing zones in divided or separated shells has often been accomplished by circulating water or other coolant through conduits extending through those zones. The selected coolants typically increased in temperature, but remained in the liquid phase while traversing the coolant conduits. The conduits usually linked the condensing zones in series flow relation since series flow coolant schemes required lower coolant flow rates than did parallel coolant flow schemes when both utilized constant phase coolant therein such as water. Condenser shell separation zoning or cycle fluid segregation, while increasing cycle efficiency, adds complexity and cost and becomes economically advantageous when the condenser coolant's temperature rise becomes high. Temperature rises characteristically increase from once-through cooling to wet cooling to dry cooling with the relatively large temperature rises being typical of dry cooling.

While dry cooling requires higher capital costs than wet cooling and wet cooling, in turn, has higher capital costs than once-through cooling, it is often desirable to obtain dry cooling's advantages of substantially no makeup coolant being required in the condenser cooling circuit, vapor plumes from the cooling towers being eliminated, and environmental coolant temperature rise restrictions for once-through systems being overcome. In addition to dry cooling's greater hardware costs than both wet cooling and once-through cooling, dry cooling often suffers from greater operating costs. The relatively greater operating costs are primarily due to optimization of heat transfer area and operating cost. To maintain the capital cost of heat transfer surface area at an acceptable level it is often necessary to reduce the cycle efficiency by either consuming more power in forced convection or allowing higher condensing temperatures. Additionally, dry cooling, as well as wet cooling, consumes large quantities of pumping power used to circulate liquid coolant such as water which has absorbed sensible heat from the cycle elastic fluid vapor and must then, itself, be cooled.

The previously mentioned disadvantages of dry cooling could be greatly minimized by lowering the cycle vapor's condensing temperature and pressure, decreasing the heat transfer surface area required by previous dry cooling schemes, and reducing the pumping power required by both wet and dry cooling systems.

SUMMARY OF THE INVENTION

In accordance with the present invention an improved dry cooling scheme is provided for condensing vapor which exhausts from an elastic fluid turbine in an elastic fluid power cycle. The invention generally comprises a heat source for vaporizing an elastic fluid, an elastic fluid turbine in fluid communication through an inlet with the heat source and having a plurality of exhaust ports for expelling variably pressurized portions of the motive, elastic fluid therethrough, a dry cooling tower utilizing air as the cooling medium, and means for condensing each of the motive fluid portions by transferring heat from the motive fluid to the air passing through the cooling tower.

In a preferred embodiment of the invention a plurality of intermediate elastic fluid condensing sections operable at different condensing temperatures and arranged such that each is in fluid communication with an exhaust port. To maintain the condensing sections at their predetermined different condensing pressures a dense fluid coolant is circulated through separate cooling circuits having heat absorption portions which are associated with the intermediate condensing sections and heat rejection portions disposed in the cooling tower. The dense fluid coolant pressure in each cooling circuit is fixed at a level where the coolant, in circulating from the condensing sections to the cooling tower and back, changes phase between a liquid and a vapor at substantially constant temperature. In addition, the portion of the coolant circuits exposed within the cooling tower are arranged in series airflow relation. The cooling circuit temperatures are caused to vary from a minimum upstream to a maximum downstream relative to the direction of cooling airflow.

Another preferred embodiment of the present invention includes a plurality of heat exchange conduits arranged in the cooling tower in portions such that each portion is in fluid communication with one of the exhaust ports and the heat source. The heat exchange conduits are situated in the cooling tower in series airflow relation with the condensing temperatures in the conduits varying from a minimum upstream to a maximum downstream relative to the normal direction of cooling airflow.

BRIEF DESCRIPTION OF THE DRAWING

The invention will be more fully understood from the following detailed description of a preferred embodiment taken in connection with the accompanying drawings, in which.

DESCRIPTION OF THE PREFERRED EMBODIMENT

The present invention is concerned primarily with dry cooling systems for transferring heat from a power cycle to the atmosphere. Accordingly, in the description which follows, the invention is shown embodied in a power plant system utilizing one or more elastic fluid turbines.

Figure 1:
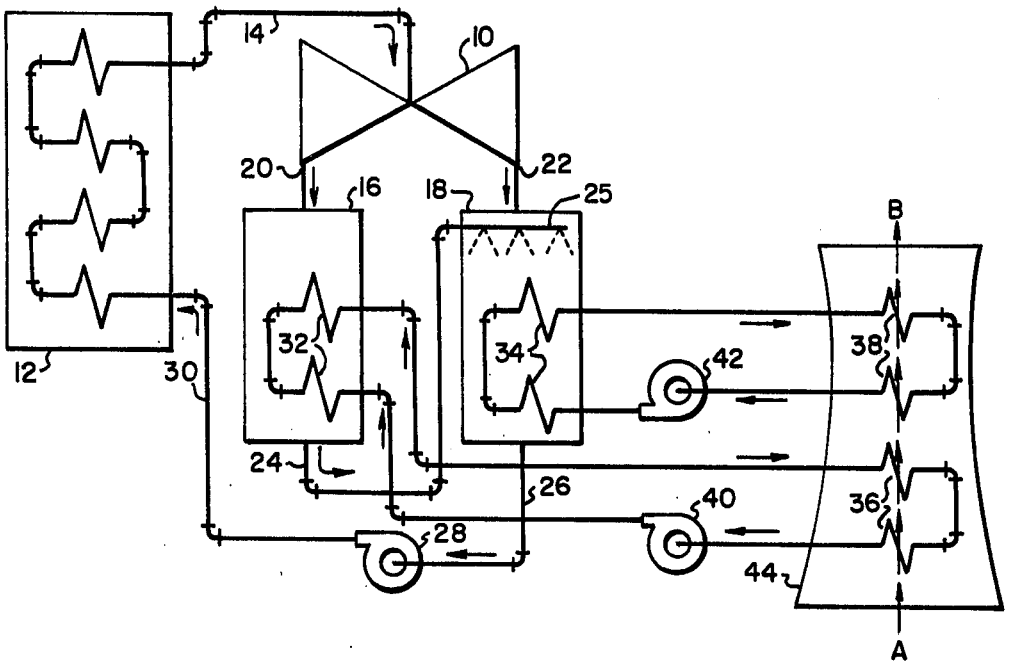
FIGS. 1, 2, 3, and 4 are schematic illustrations of dry cooled power systems.

In FIG. 1, the invention is shown transferring heat from vapor exhausted by elastic fluid turbine 10. High pressure, high temperature elastic fluid is transmitted from vapor generating means 12 such as a boiler through conduit 14 to the inlet of turbine 10. After expansion through turbine 10, the motive elastic fluid passes into intermediate condensing sections 16 and 18 through turbine exhaust ports 20 and 22, respectively. While only one double flow turbine with its attendant double exhaust ports is schematicized in FIG. 1, it is to be understood that a single flow turbine having multiple exhaust ports could be utilized as well as any combination of the two or a multiple number of either. Double flow turbine 10 is schematically illustrated because many large power generation systems utilize such turbines as low pressure components situated downstream from the high pressure components.

Condensate from intermediate low pressure condensing section 16 is preferably routed to intermediate high pressure condensing section 18 where it is sprayed into intimate contact with entering vapor through spray pipe 25. Since turbine 10 is suitably designed to account for the differing exhaust pressures at exhaust ports 20 and 22, the cycle efficiency is increased over that of a single pressure exhaust turbine. Such low pressure condensate routing can be accomplished by pumping the low pressure condensate into the high pressure section 18 or suitably arranging intermediate condensing sections 16 and 18 in such manner that condensate from section 16 will flow by gravity into section 18. Low pressure condensate spray condenses some of the vapor entering section 18 reducing the heat load on and thus the heat transfer surface area requirement in condensing section 18. The resulting condensate from condensing section 18 is drained to feedwater pump 28 through line 26 and subsequently returned to vapor generator 12 through line 30. Condensate from the aforementioned scheme will be at a relatively high temperature and will thus require reduced heating by the boiler to vaporize it.

Figure 2:
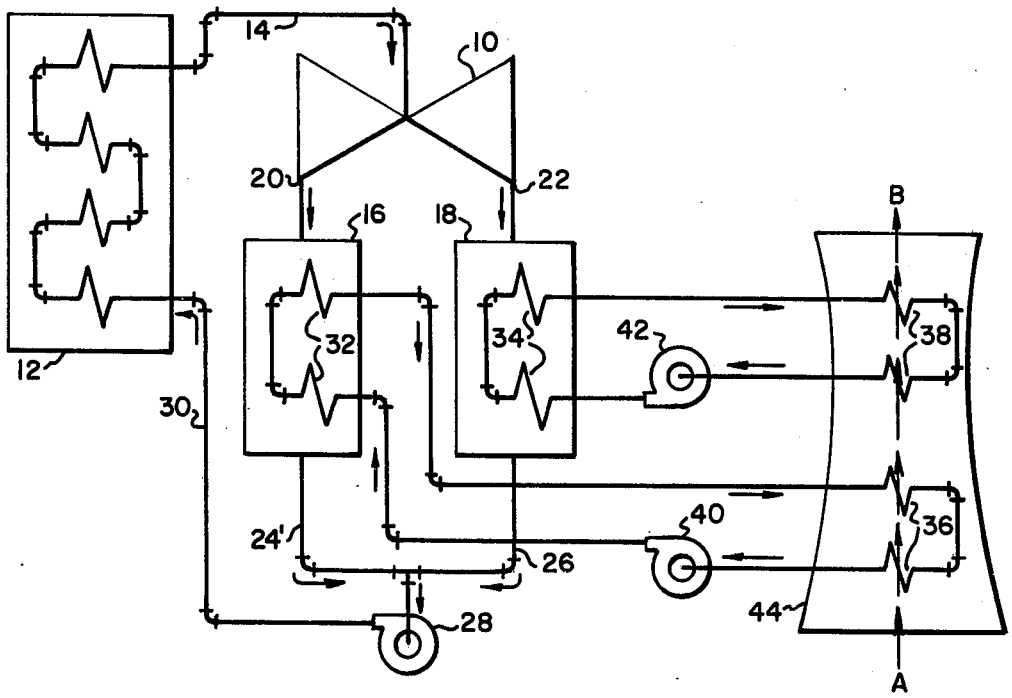

FIG. 2 illustrates an alternative scheme where condensate from condensing sections 16 and 18 is drained through lines 24' and 26 to feedwater pump 28. The mixed condensate is then returned to vapor generator 12 through line 30. The condensate's flow path downstream from the feedwater pump 28 is not considered part of the present invention and other flow paths, incorporated apparatus, and variations thereon, such as regenerative feedwater heaters are considered ancillary to the present invention.

The use of zoned or multi-pressure condensers such as intermediate condensing sections 16 and 18 on multiexhaust turbines increase power plant cycle efficiency over that of a cycle utilizing a single pressure condenser having a surface area equal to that of the multi-pressure condensers. While separate condensing sections 16 and 18 are illustrated in FIGS. 1 and 2, it is to be understood that they may in fact be separate zones within a single vessel which have been formed by including appropriate divisional walls therebetween. Condensing sections 16 and 18 have heat absorbing portions 32 and 34 respectively situated therein for transmitting coolant therethrough while condensing the cycle fluid vapor on their exterior.

The coolant used in each condensing section is chosen for its phase changing capability at moderate temperatures. Such coolants include dense fluids such as $NH_3$, Freon, or $SO_2$, by example. Heat absorbing portions 32 and 34 are in fluid communication with heat rejection condensing portions 36 and 38 respectively and constitute therewith separate cooling circuits. The dense fluids and their pressures in the cooling circuits are selected to maintain the cycle condensing temperature and pressure at the desired levels by changing phase from a liquid to a vapor in the respective heat absorbing portions and returning to the liquid phase from the vapor phase in the respective heat rejection portions. The coolant is forced through the respective cooling circuits by pumps 40 and 42 which may be deleted in some cases where thermo syphons are sufficient to overcome the frictional losses in each of the cooling circuits.

Figure 3:
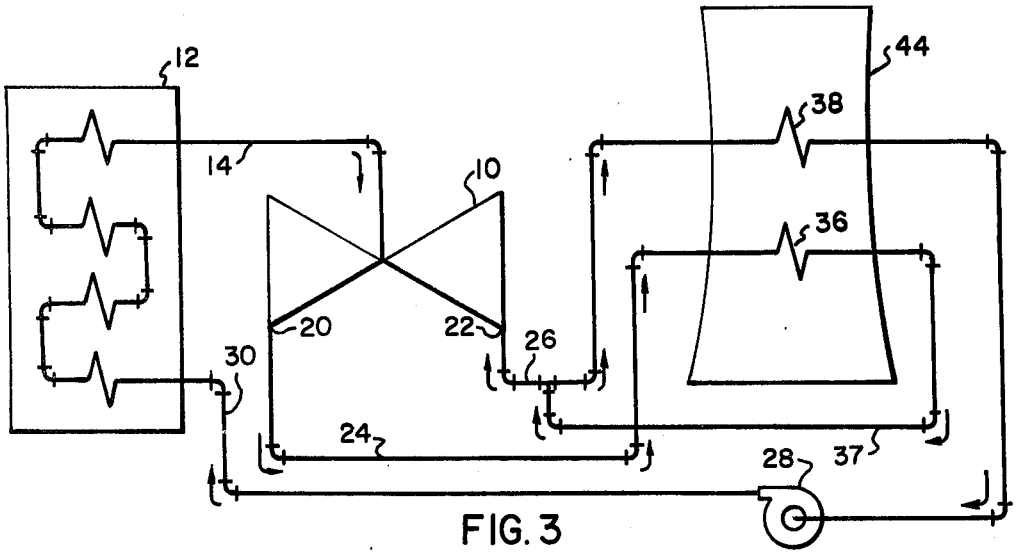

FIG. 3 illustrates an additional air-cooling scheme where elastic fluid, after expanding through turbine 10, passes into heat rejection, condensing portions 36 and 38 situated in cooling tower 44 through low and high pressure turbine exhaust ports 20 and 22 respectively. Heat rejection portions 36 and 38 constitute a large number of thin walled tubes. Lines 24 and 26 conduct the exhausted elastic fluid from the exhaust ports 20 and 22 to the condensing portions 36 and 38. Low pressure condensate exiting heat rejection-condensing portion 36 is then routed through line 37 to be mixed with high pressure elastic fluid passing through line 26 upstream from heat rejection portion 38. Such routing can be accomplished by either pumping or using gravitational flow as previously described. By mixing low pressure condensate with high pressure elastic fluid vapor, the heat load and the heat transfer surface area required in heat rejection-condensing portion 38 are reduced.

Figure 4:
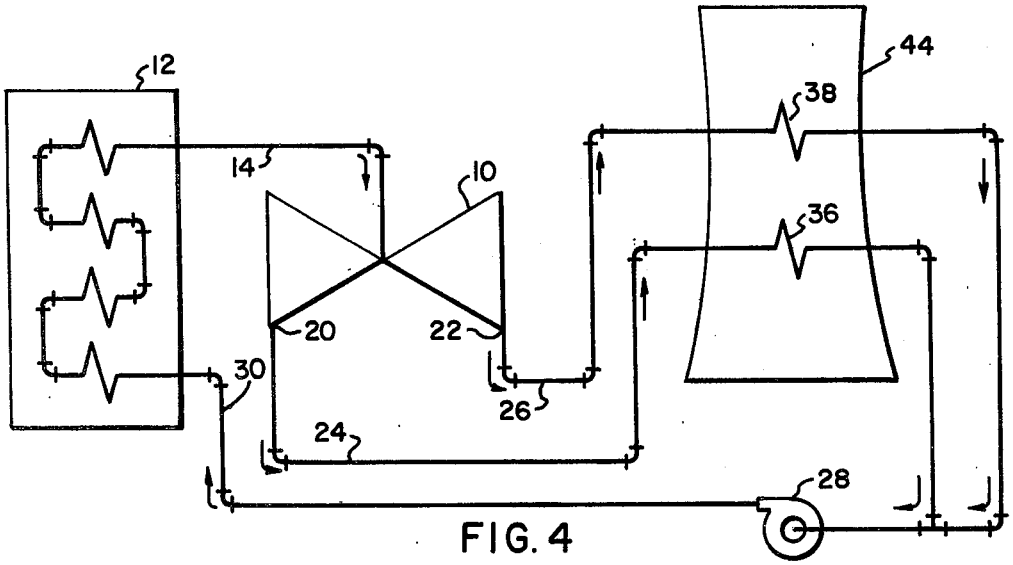

FIG. 4 illustrates an alternate arrangement to that of FIG. 3 in that condensed elastic fluid from heat rejection portions 36 and 38 are mixed prior to entering feed pump 28.

Heat rejection, condensing portions 36 and 38 are illustrated within dry cooling tower 44 which may be a natural draft structure as schematicized or a forced convection apparatus (not shown). Cool air enters cooling tower 44 at point A, successively traverses relatively cool heat rejection portion 36, hot heat rejection portion 38, and finally exits cooling tower 44 flowing past point B at an elevated temperature. By disposing the relatively cool cooling circuit or heat exchange conduit upstream from the relatively hot cooling circit or heat exchange conduit, the optimum arrangement for minimizing total hardware and increasing the heat transfer efficiency of the condensing apparatus is realized.

Use of multiple pressure heat rejection, condensing sections disposed in a dry cooling tower with the progressively warmer condensing sections being arranged downstream from the relatively cool condensing sections and in series airflow relationship therewith can result in lower total capital costs, substantially lower pumping power consumption, substantially zero makeup coolant requirements, and avoidance of a vapor plume at the exit from the cooling tower. While two condensing portions have been illustrated, any number of condensing portions may be used singly or in combination with, in the case of intermediate condensing sections, their accompanying coolant circuits which transmit phase changing coolant between the condensing portions and intermediate condensing sections where the cycle fluid is condensed.

I claim:

1. A power plant system comprising:

a heat source for vaporizing a motive, elastic fluid;

an elastic fluid turbine in fluid communication with said heat source through an inlet port, said turbine having a plurality of exhaust ports for expelling through each a portion of said motive fluid at a predetermined pressure;

a dry cooling tower utilizing air as the cooling medium; and a plurality of continuous heat exchange conduits providing fluid communication from said turbine exhaust ports upstream from said cooling tower to said heat source downstream from said cooling tower, said heat exchange conduits being disposed through said cooling tower in parallel internal motive fluid flow and series external air flow, all said heat exchange conduits being fluidly interconnected such that relatively cool heat exchange conduits downstream from the cooling tower discharge their entire flows into relatively warm heat exchange conduits upstream from the cooling tower.

2. The power plant system of claim 1 wherein said separate heat exchange conduits are situated in said cooling tower in series airflow relation with the conduits of increasing temperature being situated along the normal airflow direction.

* * * * *